US007861640B2

(12) United States Patent
Lippard

(10) Patent No.: US 7,861,640 B2
(45) **Date of Patent: *Jan. 4, 2011**

(54) BARREL LINK FOR A SEMI-AUTOMATIC WEAPON

(75) Inventor: Karl C. Lippard, 3259 Electra Dr. South, Colorado Springs, CO (US) 80906

(73) Assignee: Karl C. Lippard, Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/718,836

(22) Filed: Mar. 5, 2010

(65) Prior Publication Data

US 2010/0154273 A1 Jun. 24, 2010

Related U.S. Application Data

(63) Continuation of application No. 12/106,284, filed on Apr. 19, 2008, now Pat. No. 7,673,553.

(60) Provisional application No. 60/939,310, filed on May 21, 2007.

(51) Int. Cl.
*F41A 3/86* (2006.01)

(52) U.S. Cl. ..... 89/196; 89/163; 42/75.01

(58) Field of Classification Search ..... 89/163, 89/196; 42/75.01
See application file for complete search history.

(56) References Cited

U.S. PATENT DOCUMENTS

| | | | | | |
|---|---|---|---|---|---|
| 3,207,037 | A | * | 9/1965 | Pachmayr et al. | 89/196 |
| 3,241,449 | A | * | 3/1966 | Dwyer, Sr. | 89/196 |
| 3,411,404 | A | * | 11/1968 | Pachmayr et al. | 89/163 |
| 3,435,727 | A | * | 4/1969 | Miller et al. | 89/163 |
| 4,934,247 | A | * | 6/1990 | Piscetta | 89/163 |

* cited by examiner

*Primary Examiner*—J. Woodrow Eldred
*Assistant Examiner*—Gabriel J Klein
(74) *Attorney, Agent, or Firm*—Gregory & Martensen LLP; Michael C. Martensen

(57) ABSTRACT

An improved barrel link for consistently and reliably placing a barrel of a semi-automatic pistol into battery is disclosed. One embodiment of the present invention extends the width of the barrel link beyond that of the receiving channel of the barrel lug legs so as to substantially equal the exterior dimension of the barrel lug. In addition, the portions of the barrel link extending beyond the width of the channel of the barrel lug are designed to provide multiple points of contact with the front face of the barrel lug in both vertical and horizontal positions so as to reliably and consistently place the barrel into battery. The additional width of the barrel link and additional contact between the link and barrel lug aids in stabilizing lateral and rotational forces prolonging the life of the weapon.

15 Claims, 3 Drawing Sheets

BARREL LINK FOR A SEMI-AUTOMATIC WEAPON

RELATED APPLICATION

The present invention claims priority from, and is a continuation application of, U.S. patent application Ser. No. 12/106,284 filed Apr. 19, 2008, which is related to, and claims the benefit of U.S. Provisional Patent Application Ser. No. 60/939,310 filed May 21, 2007, all of which are incorporated herein by reference in their entirety for all purposes as if fully set forth herein.

BACKGROUND OF THE INVENTION

1. Field of the Invention

Embodiments of the present invention relate, in general, to a barrel link and particularly to a barrel link compatible with standard barrels found in semi-automatic pistols.

2. Relevant Background

A semi-automatic pistol functions by using the energy from the recoil of a single round of ammunition to extract and eject a fired cartridge from the pistol's chamber and load an unfired round from a magazine into the chamber for the next shot.

Most types of semi-automatic pistols rely on a removable magazine for supplying new ammunition to reload the chamber to be able to fire the gun again. The removable magazine is most often located inside a hand grip. Typically, the first round is manually loaded into the chamber by pulling back and releasing ("racking") the slide mechanism, after which the recoil operation of the pistol, when fired automatically, extracts, ejects, and reloads the chamber.

For a semi-automatic pistol, reload is typically accomplished by the recoil operation. This process can also be accomplished by harnessing gases produced when the gun is fired. In this case, the pistol siphons off some of the gases during the firing phase instead of relying on short recoil operation.

Self-loading automatic pistols can be divided into "blowback" and "locked-breech" categories according to their principle of operation. This classification roughly divides the operation into those specifically suitable for small-caliber versus large-caliber semi-automatic pistols.

In blowback semi-automatic pistols, generally .38 caliber (sometimes known as 9 mm Kurz, i.e., 9 mm Short) or smaller, the barrel is fixed to the frame and the slide or bolt; in its foremost position, it is held against the barrel only by the force of the recoil spring. The slide starts to move backwards immediately upon the gun being fired, as there is no locking action to hold the breechblock and slide locked with the barrel, even temporarily. At the appropriate point in the rearward motion, extraction and ejection of the fired brass of the cartridge are accomplished, and the used brass is typically ejected to the right of the pistol.

During the motion rearwards, the striker, hammer, or firing pin may be re-cocked. A spring, called a recoil spring, slows the movement of the slide as it is compressed. When the slide reaches the rear of its travel, the recoil spring is fully compressed (if not, the pistol may suffer a failure, called a "jam"). The slide begins to move forward under the force of the spring, stripping a new cartridge from the magazine and pushing the new cartridge into the chamber. Upon the slide's return to its fully forward position, the pistol is ready once more to be fired by squeezing the trigger. The mass of the slide must be sufficient to hold the breech closed until the bullet exits the barrel and the remaining pressure drops to a safe level. A cartridge with too high a pressure, or a slide with too little mass, can cause the cartridge case to extract too early; this causes a case rupture.

In contrast, in a locked-breech design (typically .32 caliber or larger) the barrel is temporarily locked to the slide. The most common locked-breech type is the short-recoil design. In a short-recoil pistol, the slide and barrel recoil together a short distance while locked together, until the cartridge-firing chamber pressure has dropped to a safe level. After sufficient travel to allow the bullet to exit and the pressure to drop, the barrel then unlocks from the slide, and the barrel's rearward motion is stopped. The ejection and loading of the new cartridge are similar to that in a blowback pistol. After the slide seats the new round into the chamber, the barrel begins to move forward with the slide, locking into place, at which point the cycle is complete.

FIGS. 1-3 show side projection cut away views of a Colt M-1911 semi-automatic pistol as is known in the prior art in various phases of operation. FIG. 1 shows a side projection cut away view of the Colt M-1911 ready for firing. FIG. 2 shows a side projection cut away view of the Colt M-1911 in the recoiled position. In a locked-breech design, the barrel 110 is locked during what is generally known in the art as link-up. Barrel link-up or link-up/cam-up in pistols occurs as the slide assembly 120 moves forward from the recoiled position and the barrel breech 135 contacts the breech face 140 of the slide 120 causing the barrel to pivot upward on the barrel link 150. This causes the locking lugs 155 on the top of the barrel to index with the corresponding locking recesses 160 in the slide. Barrel link-up/cam-up in M-1911 pistols with bottom barrel lugs is assisted by the cam action of the bottom front barrel lug surfaces as they bear on and cam upward on the slide lock cross pin 156.

Vertical barrel and slide locking occurs as the slide 120 causes the barrel 110 to swing upward on the barrel link 150. Aggregate barrel 110, slide 120, frame 170, and barrel link 150 dimensional tolerances determine the extent to which a given barrel will link upward and to which locking lugs 155 will vertically engage in any given M-1911 or similarly designed pistol. Locked slide position permits the barrel 110 to move upward and prepares the pistol for firing, as shown in FIG. 1. This is also referred to by one skilled in the art as being locked in battery or in a battery position.

Firing is split into two phases because the thrust vector existing between the bullet and the breech is under pressure in the barrel. Firing occurs in the M-1911 pistols when the grip safety is depressed, the trigger is squeezed, and the interaction of the trigger releases the hammer. The released hammer then transfers its energy to the internal firing pin, which, in turn, strikes the primer. As the primer ignites the propellant charge in the chambered cartridge, the hot powder gasses expand thus building pressure that forces the bullet down the barrel. As the gasses expand, the barrel 110 and slide 120 remain locked together both horizontally and vertically during the initial firing phase. Then as the bullet travels down the barrel shown in FIG. 3, the barrel begins to move rearward pivoting on the link and link pin 150,156.

At the end of the firing phase, the bullet exits the muzzle and drops gas pressure inside the barrel. Bullet departure breaks the balanced thrust vector established when the bullet was in the barrel 110. In terms of the effect on the pistol, this action enables the top locking lugs 155 to horizontally disengage and imparts a rearward force on the slide 120 assembly equal to the inertia of the departing bullet. Then, because the slide 120 assembly has a greater relative mass, and with the added benefit of the recoil spring, inertial energy is absorbed as the slide recoils to the rear. FIG. 3 shows a side projection cut away view of the Colt M-1911 shortly after firing and the bullet's exit from the barrel. In pistols with standard ordnance dimension barrels, barrel link-down and vertical locking lug disengagement begin momentarily after the lugs 155 horizontally disengage at zero breech pressure just after the firing of a chambered round.

As can be appreciated by one skilled in the art and as shown in FIG. 3, the barrel link 150 is coupled to the barrel 110 by a lug pin 152 and to the frame 170 by a slide stop pin 156. As the barrel 110 moves forward, the curved portion of the barrel lug 130 aids in forcing the barrel 110 into a full lock-up position. The barrel lug 130 (sometimes referred to as link lugs) in the M-1911 is an integral part of the barrel 110 that extends from the barrel to form two laterally spaced legs. The channel formed by the legs of the barrel lug 130 receives and supports the barrel link 150. The accuracy of the M-1911 is determined by the consistency at which the barrel 110 is placed into battery. As can be appreciated by one skilled in the art, each time the barrel is removed from battery to eject the expended casing and then placed back into battery with a new round, the placement of the barrel 110 with respect to the slide 120 and frame 170 may be slightly different. This inconsistency drives the ultimate accuracy of the weapon. A term known to one skilled in the relevant art for a measure of accuracy of a weapon is Minutes of Angle ("MOA"). One MOA is a mathematical term for 1/60th of an arc degree. 60 MOA=1 hour=1 deg. MOA measures the dispersion of a firing pattern at a certain range. One MOA at one hundred yards would be approximately 1 inch.

The accuracy of the M-1911 is inherently limited by the ability of barrel 110 to consistently achieve the same position in battery. This is reflected by its MOA. For example, if the barrel never left battery and was essentially a breech loaded single shot weapon, the MOA may be an order of magnitude smaller than that of a weapon in which the barrel is routinely disengaged and then reengaged into a battery position. The barrel link 150 is the primary means in the M-1911 by which the barrel is placed into battery, thus the vertical and horizontal movement of the barrel link 150 degrades the M-1911's accuracy. The link 150 acts as a single pivot point that transforms the forward motion of the barrel, as imparted to the barrel by the recoil of the slide, into a vertical motion so as to engage the lugs 155 and place the barrel into battery.

Furthermore, after repeated firings bearing stress, creep, due to the heat involved in repeated firings, and strain from the barrel link 150 and the pins coupling together slide 120, frame 170, and the barrel 110, reduces the ability of the link 150 to adequately and consistently place the barrel 110 into battery. After several hundred rounds of firing, the inherent accuracy of the weapon degrades and its MOA increases. The slide locking surfaces and those of the barrel 110 begin to degrade upon the first round fired. As a result, the economic life of the weapon is significantly reduced. Furthermore, accuracy is markedly lost in the first 250 rounds so as to make the firearm unable to perform as intended.

SUMMARY OF THE INVENTION

Disclosed herein is an improved barrel link for consistently and reliably placing a barrel of a semi-automatic pistol into battery. One embodiment of the present invention extends the width of the barrel link beyond that of the receiving channel of the barrel lug legs so as to make it substantially equal to the exterior dimension of the barrel lug. In addition, the portion extending beyond the width of the channel of the barrel lug is designed to provide multiple points of contact with the barrel lug in both vertical and lateral positions so as to reliably and consistently place the barrel into battery.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

According to one embodiment of the present invention, an improved barrel link is disclosed that interacts with a standard M-1911 barrel or the like. The improved barrel link includes a widened section of the lower portion of the link designed to engage the barrel lug in multiple locations as well as to provide increased lateral and rotational stability to the barrel as it is conveyed from the recoiled position into battery. According to one embodiment of the present invention, the lower portion of the barrel lug includes a section of increased width that has two faces. Each face is designed to mate with the curved portion of the barrel lug. A first face is configured to be in constant contact with the barrel lug while the barrel is rotated from the recoiled position to that of battery. The second face is configured to come into contact at the final portion of that conveyance to ensure that the barrel comes into battery consistently and reliably.

BRIEF DESCRIPTION OF THE DRAWINGS

The aforementioned and other features and objects of the present invention and the manner of attaining them will become more apparent, and the invention itself will be best understood, by reference to the following description of a preferred embodiment taken in conjunction with the accompanying drawings, wherein.

Figure 1:
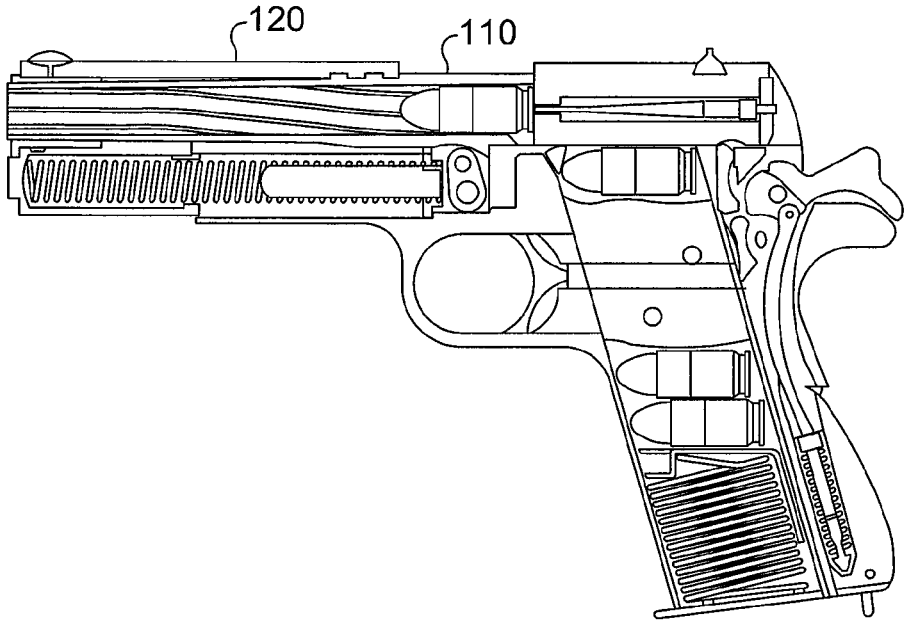
Fig. 1 Prior Art
FIG. 1 shows a side projection cut away view of the Colt M-1911 ready for firing as is known in the prior art.
Figure 2:
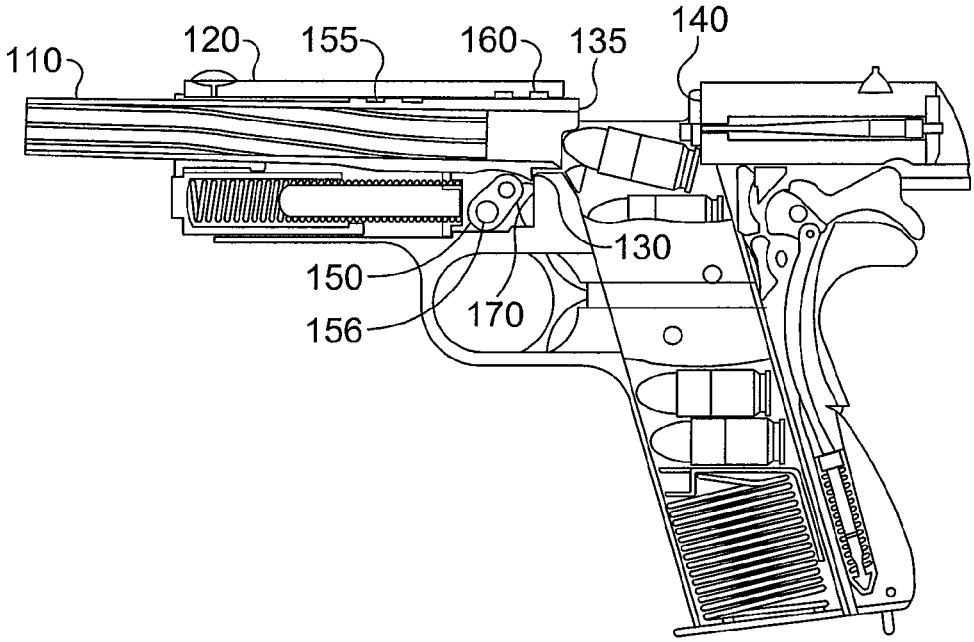
Fig. 2 Prior Art
FIG. 2 shows a side projection cut away view of the Colt M-1911 in the recoiled position as is known in the prior art.
Figure 3:
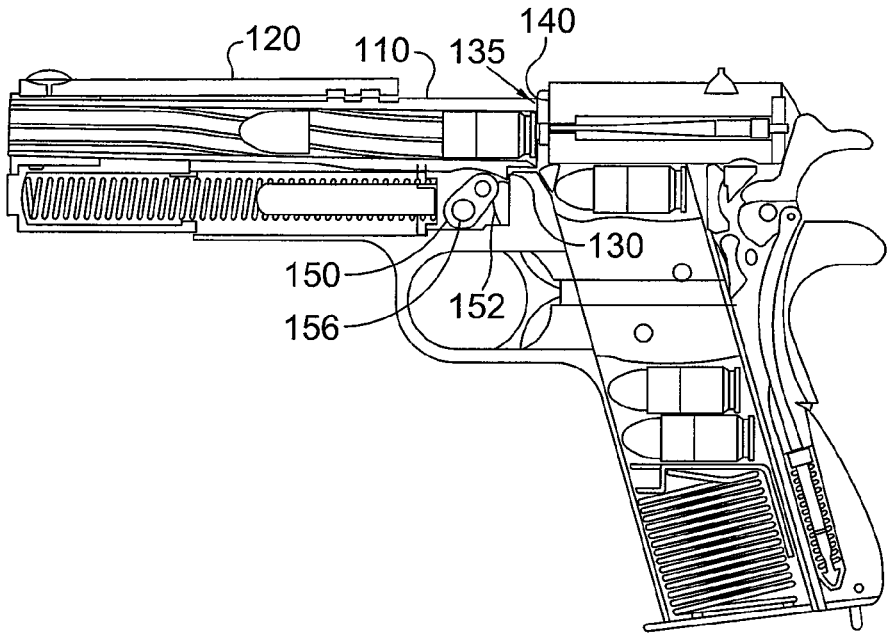
Fig. 3 Prior Art
FIG. 3 shows a side projection cut away view of the Colt M-1911 shortly after firing and the bullet's exit from the barrel as is known in the prior art.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

An improved barrel link for a semi-automatic pistol is described hereafter by way of examples. According to one embodiment of the present invention, the link rotationally coupling the barrel to a pistol frame or housing is improved by increasing the width (thickness) of the lower portion of the link and by placing at least two faces on the expanded portion of the link to connect with the barrel lug to provide lateral and rotational stability.

Specific embodiments of the present invention are hereafter described in detail with reference to the accompanying Figures. Like elements in the various Figures are identified by like reference numerals for consistency. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

Figure 4:
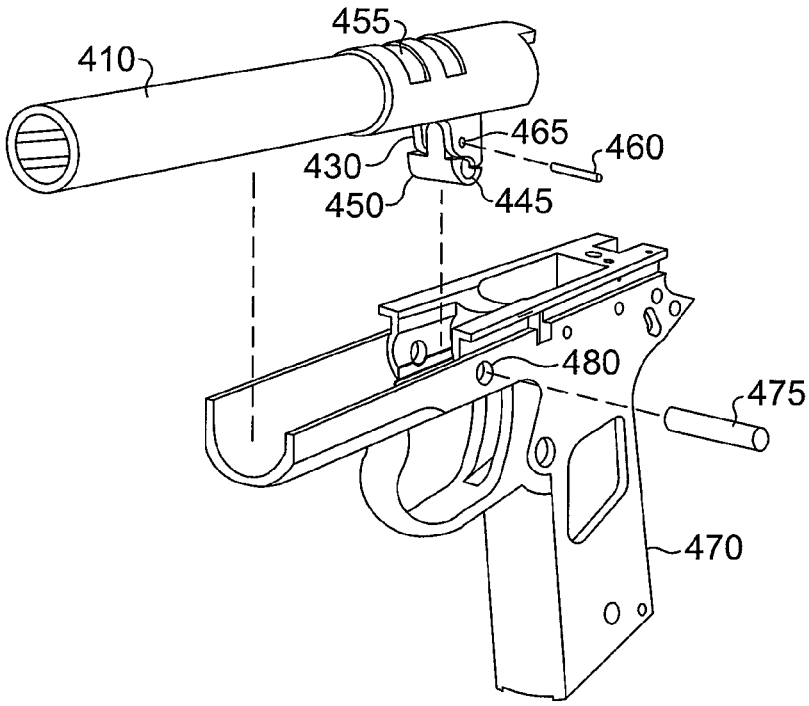
FIG. 4 is a perspective cut away view of a barrel, barrel link, and frame interaction according to the present invention.

FIG. 4 is a perspective cut away view of the interaction of a barrel, improved barrel link, and frame according to the present invention. The barrel 410 is coupled to the handgrip housing 470 (also referred to herein as the frame) via an improved link 450. The link 450 is rotationally coupled to the barrel 410 via a barrel lug 430. The lug 430 comprises two extensions or legs extending perpendicularly from the barrel 410 forming a channel. Each extension includes an opening 465 receptive to a first pivot pin 460. The link 450, which has two openings, is interposed between these extensions and is coupled to the barrel lug 430 via the first pivot pin 460. The first pivot pin 460 occupies the opening in each extension 465 and the uppermost opening (not shown) in the link 450.

Similarly, an opening 480 is present in the handgrip housing 470 that is receptive of a second pivot pin 475. The lower portion of the link 450 is rotationally coupled to the handgrip housing 470 via the interaction of the second link opening 445, the handgrip housing openings 480, and the second pivot pin 475.

Figure 5:
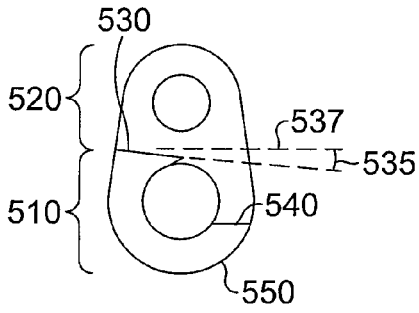
FIG. 5 is a side view of an improved barrel link according to the present invention.
Figure 6:
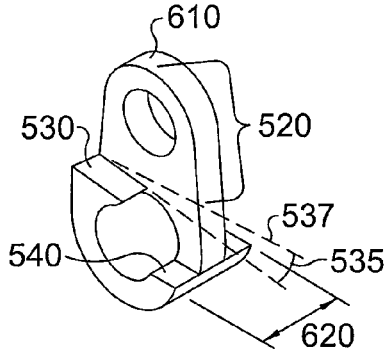
FIG. 6 is a perspective view of an improved barrel link according to the present invention.

FIGS. 5 and 6 show a side and perspective view respectively of an improved barrel link according to one embodiment of the present invention. Turning first to FIG. 5, it can be seen that the link is divided into two portions, a lower portion 510 and an upper portion 520. The lower portion 510 includes a section 550 of increased width as measured from an end perspective (see FIGS. 6 and 10). This section 550 includes two faces 530, 540 that are configured to mirror the curved surface and design of the barrel lug that extends from the main body of the barrel. Each face 530, 540 (two each) extends perpendicular (out of the paper) from either lateral side of the link. These faces mirror the width of the barrel lug extensions. As can be seen in FIG. 5, the uppermost face 530 is configured to be at a slightly depressed angle 535 as compared to a horizontal reference line 537. The slight depression in the face enables the link to continuously engage the barrel lug extension as the barrel rotates in and out of battery. This added lateral and rotational stability aids in reducing deterioration over repeated firings (cycles) as well as ensuring that as the barrel returns to battery its placement is consistent and reliable.

FIG. 6 presents a perspective view of the improved barrel link shown in FIG. 5. Evident in this perspective view is the added width of the lower portion of the link. The upper portion of the link 520 possesses a width 610 such that it can be interposed between the barrel lug extensions. The lower portion of the link 510 includes a section 550 of increased width 620. As shown in FIG. 6, the section of increased width 550 of the lower portion 510 has two faces 530, 540. These prevent lateral yaw of the link, even after the second pivot pin 475 degrades and becomes worn. This extends the life of the barrel 110 and slide in spite of wear. Each of these faces aid in stabilizing the link and barrel combination as it moves into battery. Furthermore, the faces add supplemental surface area by which to convey rotational forces imparted to the barrel from the bullet as results from the rifling in the barrel. As the bullet accelerates down the length of the barrel, barrel rifling induces a spin in the bullet to enhance longitudinal stability of the bullet during flight. This induced spinning places a torque on the barrel that is conveyed to the handgrip housing by way of the link. Prior to the present invention, this force was conveyed to the handgrip housing via the second pivot pin. As can be seen in FIG. 4, the locking lugs 455 of the barrel do not offer any resistance to the barrel rotating about its longitudinal axis. Only the link pin offers such a resistance. As a result, the pin openings, and indeed the pin itself, experience significant deterioration resulting in increased variance in placing the barrel into battery. According to one embodiment of the present invention, the additional width of the barrel link and the presence of the two faces in contact with the barrel lug enable an improved conveyance of force to the handgrip housing. This more efficient conveyance of force to the handgrip housing not only improves the accuracy of the weapon but enhances its durability and enables the weapon to maintain its accuracy over an extended number of firings.

Figure 7:
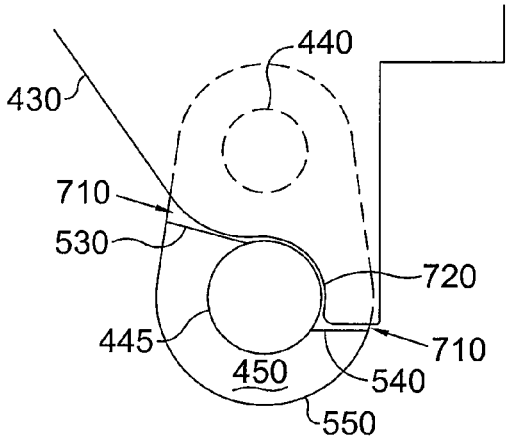
FIG. 7 is a side view of a barrel lug from a Colt M-1911 barrel and an improved barrel link according to one embodiment of the present invention.

FIG. 7 is a side view of a barrel lug from a Colt M-1911 barrel (or the like) and an improved barrel link according to one embodiment of the present invention. While the invention has been particularly shown and described with reference to a preferred embodiment and with the interaction of Colt M-1911 components, it will be understood by those skilled in the art that various other changes in the form and details may be made without departing from the spirit and scope of the invention. For example, the implementation of an improved barrel link is applicable to a variety of pistols and other weapons beyond the M-1911.

As can be seen in FIG. 7, this rendition of the barrel lug 430 shows the extensions extending from the barrel to include a curved front face with several inflection points. The link 450 is rotationally coupled to the barrel lug via a first pivot pin that traverses the aligned openings 440 in the upper portion of the barrel link 450 and the barrel lug 430. The lower opening of the barrel link 445 is configured to accept the second pivot pin for coupling the link to the handgrip housing. The lower portion of the link 450 includes the expanded section 550 possessing two lateral faces 530, 540. These faces offer additional contact between the link 450 and the link lug 430.

As the barrel is conveyed into battery, the link interacts with the link lug in at least two locations 710 on each barrel lug extension. In addition to the second pivot pin's interaction 720 with the link lug, these lateral surfaces of the barrel link 710 stabilize the barrel. The added contact area between the link and the link lug, as well as the width of the link within the handgrip housing, provides the barrel with increased consistency in repeatedly achieving battery in precisely the same position. Furthermore, the distribution of the stress over significantly more material and away from stress points found within the openings of the link aid in prolonging the usefulness of the link.

Figure 8:
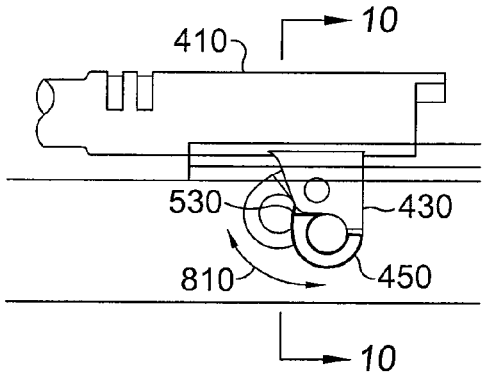
FIG. 8 is a side view of a barrel and improved barrel link combination depicting the rotational action of the link and the points of contact between the link and barrel lug according to one embodiment of the present invention.

FIG. 8 shows a side view of the range of motion of an improved barrel link 450 coupled to a barrel lug 430 according to one embodiment of the present invention. The arc 810 depicts the rotational range of the improved link 450. Note that throughout the arc 810 the upper face 530 of the lower portion of the barrel link 450 is always in contact with the curved portion of the barrel lug 430. One skilled in the art will recognize that while FIG. 8 shows the link rotating in reality, the lower portion of the link 450 remains coupled to the handgrip housing 470; it is the barrel 410 and barrel lug 430 that rotate to the right and down as a result of the weapon being fired.

Figure 9:
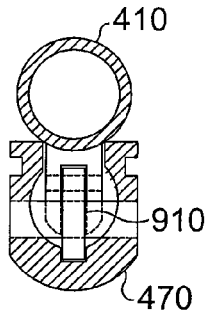
Fig. 9 Prior Art
FIG. 9 is an end view of a barrel, frame, and barrel link as is known in the prior art.
Figure 10:
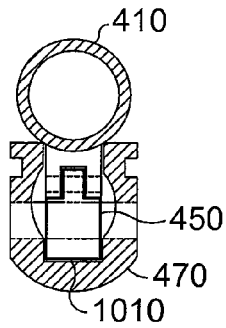
FIG. 10 is an end view of a barrel, frame, and improved barrel link according to the present invention.

FIGS. 9 and 10 present a comparison end cut view of the barrel and barrel link interaction. FIG. 9 presents an end view of the barrel 410, barrel link 910 and handgrip housing 470 as is known in the art. Note that the barrel link of the prior art 910 is of uniform width. FIG. 10 by comparison shows a barrel 410 coupled to an improved barrel link 450 that is in turn coupled to the handgrip housing 470. The handgrip housing channel 1010 is modified so as to accept the additional width of the improved barrel link 450. The added width of the improved barrel link 450 along with the faces of the barrel link interacting with the barrel lug 430 enable the barrel to convey stress from the barrel to the handgrip housing 470 more efficiently and with less deterioration of the link and the pivot pins. Furthermore, the added width of the link restricts the barrel's ability to rotate.

The improved barrel link also ensures a consistent and reliable cycling of the barrel upon firing. The added width and additional guiding faces place the barrel battery in a consistent reliable position. Rather than having a wide variance of the position of the barrel in battery with respect to the slide, the barrel is reliably placed in battery with minimal variation.

While there have been described above the principles of the present invention in conjunction with an improved barrel link, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

I claim:

1. A semi-automatic hand gun barrel link comprising:

a first opening operable to pivotally couple the semi-automatic hand gun barrel link to a barrel lug extending from a barrel wherein the barrel lug includes a barrel lug curved face oriented toward a muzzle of the barrel;

a second opening operable to pivotally couple the semi-automatic hand gun barrel link to a handgrip housing linking the barrel to the handgrip housing; and a barrel link face operable to mate with and be in continuous contact with the barrel lug curved face as the barrel moves in and out of battery.

2. The semi-automatic hand gun link of claim 1 wherein the barrel lug includes a flat face substantially parallel with a longitudinal axis of the barrel and wherein the hand gun barrel link includes a second face apart from the barrel link face, the second face being in contact with the flat face when the barrel is in battery.

3. The semi-automatic hand gun link of claim 1 wherein continuous contact between the barrel link face and the barrel lug curved face minimizes lateral movement of the barrel during conveyance of the barrel into battery.

4. The semi-automatic hand gun link of claim 1 wherein continuous contact between the barrel link face and the barrel lug curved face minimizes rotational motion of the barrel about an axis perpendicular to a barrel longitudinal axis.

5. The semi-automatic hand gun link of claim 1 wherein the barrel link is configured to engage the barrel lug in at least two distinct locations when the barrel is in battery.

6. The semi-automatic hand gun link of claim 1 wherein the barrel link is configured to engage the barrel lug in at least four distinct locations when the barrel is in battery.

7. The semi-automatic hand gun link of claim 1 wherein the first opening is coupled to the barrel lug by a pivot pin, the pivot pin having a longitudinal axis perpendicular to a barrel longitudinal axis, and wherein the barrel link face, as the barrel moves in and out of battery, remains parallel to the pin longitudinal axis.

8. A system for linking a barrel of a semi-automatic hand gun to a handgrip housing, the system comprising:

a barrel link lug extending from the barrel wherein the barrel link lug includes a lug curved face oriented toward a muzzle of the barrel;

a handgrip housing receptacle; and a barrel link including a barrel link face, said barrel link having an upper portion including a first opening operable to pivotally couple with the barrel link lug and a lower portion including a second opening operable to pivotally couple with the handgrip housing receptacle linking the barrel to the handgrip housing and wherein the lug curved face continuously mates with the barrel link face during barrel motion to control link-up variance of the barrel as it moves in and out of battery.

9. The system of claim 8 wherein the lower portion of the barrel link is of a width substantially equal to a combined width of the barrel link lug and upper portion of the barrel link.

10. The system of claim 9 wherein the barrel link face comprises includes a flat face, the flat face continuously matting with the lug curved face, and wherein the flat face is parallel to a longitudinal axis of a pin coupling the upper portion of the barrel link to the barrel link lug.

11. The system of claim 8 wherein the barrel link lug includes a flat face substantially parallel with a longitudinal axis of the barrel and wherein the barrel link includes a face that contacts the flat face when the barrel is in battery.

12. A method for minimizing barrel link-up variance, the method comprising:

linking a barrel to a handgrip housing a barrel link wherein the barrel link includes an upper portion pivotally coupled to a barrel link lug extending perpendicular to a longitudinal axis of the barrel and having a curved face oriented toward a muzzle end of the barrel and a lower portion pivotally coupled to the handgrip housing wherein the barrel link is coupled to the barrel via a first pin traversing a first opening in the barrel link and to the handgrip via a second pin and a second opening in the barrel link; and controlling link-up variance of the barrel as it moves in and out of battery wherein the lower portion of the barrel link includes a face configured to continuously mate with the curved face of the barrel link lug as the barrel moves in and out of battery.

13. The method of claim 12 wherein pivotally coupling the barrel link to the barrel link lug includes inserting a barrel link pin through at least two apertures in the barrel link lug and the first opening in the upper portion of the barrel link.

14. The method of claim 12 wherein pivotally coupling the barrel link to the hand grip housing includes inserting a housing pivot pin through at least two housing apertures in the handgrip housing and the second opening in the lower portion of the barrel link.

15. The method of claim 12 further comprising receiving the lower portion of the barrel link into a handgrip housing channel wherein a handgrip housing channel width is substantially equal to a combined width of the upper portion of the barrel link and barrel link lug.

* * * * *

UNITED STATES PATENT AND TRADEMARK OFFICE

CERTIFICATE OF CORRECTION

PATENT NO. : 7,861,640 B2
APPLICATION NO. : 12/718836
DATED : January 4, 2011
INVENTOR(S) : Karl C. Lippard It is certified that error appears in the above-identified patent and that said Letters Patent is hereby corrected as shown below:

Column 8, line 48, delete the word “includes”.

Column 8, line 58, insert the word --using-- after the word “housing” and before the word “a”.

Signed and Sealed this
Twenty-second Day of February, 2011

David J. Kappos

David J. Kappos
*Director of the United States Patent and Trademark Office*